US007246727B2

(12) United States Patent
Magermans et al.

(10) Patent No.: US 7,246,727 B2
(45) Date of Patent: Jul. 24, 2007

(54) CONTAINER FOR DRINK PROVIDED WITH A CHAMBER CONTAINING A FLEXIBLE DISPENSING LINE

(75) Inventors: Marcel Peter Magermans, The Hague (NL); Piet Hein Willem Timp, Heemstede (NL)

(73) Assignee: Heineken Technical Services B.V., Zoeterwoude (NL)

( * ) Notice: Subject to any disclaimer, the term of this patent is extended or adjusted under 35 U.S.C. 154(b) by 0 days.

(21) Appl. No.: 11/505,980

(22) Filed: Aug. 18, 2006

(65) Prior Publication Data

US 2007/0045357 A1 Mar. 1, 2007

Related U.S. Application Data

(63) Continuation-in-part of application No. 10/297,719, filed on Aug. 26, 2003, now abandoned, which is a continuation of application No. PCT/NL01/00437, filed on Jun. 11, 2001.

(30) Foreign Application Priority Data

Jun. 9, 2000 (NL) ..... 1015411

(51) Int. Cl.
*B67D 5/06* (2006.01)

(52) U.S. Cl. ..... 222/529; 222/530

(58) Field of Classification Search ..... 222/529, 222/530

See application file for complete search history.

(56) References Cited

U.S. PATENT DOCUMENTS

| | | | |
|---|---|---|---|
| 2,104,466 | A | 1/1938 | Marzolf |
| 2,792,692 | A | 5/1957 | Bryan |
| 3,055,556 | A | 9/1962 | Hester |
| 4,120,425 | A | 10/1978 | Bethurum |
| 4,429,931 | A | 2/1984 | Brooks |
| 4,726,479 | A | 2/1988 | Tsai |
| 4,886,176 | A | 12/1989 | Steakley |
| 5,203,468 | A | 4/1993 | Hsu |
| 5,540,359 | A | 7/1996 | Gobbel |
| 5,897,013 | A | 4/1999 | Manganiello |
| 6,105,825 | A | 8/2000 | Gomi et al. |
| 6,481,238 | B1 | 11/2002 | Jennings et al. |
| 6,510,965 | B1 | 1/2003 | Decottignies et al. |

FOREIGN PATENT DOCUMENTS

| | | |
|---|---|---|
| DE | 43 39 889 | 4/1995 |
| NL | 1010015 | 5/1999 |
| WO | WO 99/11563 | 3/1999 |
| WO | WO 00/03944 | 1/2000 |

*Primary Examiner*—Philippe Derakshani
(74) *Attorney, Agent, or Firm*—Young & Thompson

(57) ABSTRACT

A container (1) for drink is provided with a top (2) and with an outlet (4) that is located at the top and is connected to a flexible dispensing line (5), the container having a chamber (32) at the top in which the dispensing line (5) is accommodated. The dispensing line (5) is provided at its outlet end (6) with a grip element (30) that is located in or close to a cut-out (35) in the peripheral wall. By positioning the flexible tube in the chamber this tube can be hygienically protected from the environment during storage and transport of the container and mechanical damage thereto is prevented, whilst easy handling remains possible. The chamber (32) can be closed by a lid (52).

5 Claims, 7 Drawing Sheets

CONTAINER FOR DRINK PROVIDED WITH A CHAMBER CONTAINING A FLEXIBLE DISPENSING LINE

BACKGROUND OF THE INVENTION

The invention relates to a container for drink provided with a top and with an outlet that is located at the top and is connected to a flexible dispensing line, the container having a chamber at the top in which the dispensing line is accommodated.

A container of this type is disclosed in International patent application Ser. No. WO 99/11563. In the case of the known container the flexible line is accommodated inside a cap that is fitted over an upper end face of the container. The container can have a plastic outer jacket with an internal flexible bag, containing a carbonated drink, such as beer. The container is placed in a closable chill chamber of a drink dispensing device and connected to a pressure line which feeds a pressure medium into the space between the flexible bag and the outer jacket. The flexible dispensing line is fed through a dispensing tap at the top of the chill chamber, which dispensing tap is in clamping engagement on the tube in order to close this off and releases the dispensing line by operation of a tap handle. On placing the container in the chill chamber a break seal at the top of the cap can be removed and the dispensing line can be removed from the cap in order to connect the outlet to the dispensing tap.

One disadvantage of the known container is that access to the dispenser tube via the opening in the cap is relatively difficult for the user. Furthermore, positioning of the end of the tube in the dispensing tap of the dispensing device is relatively difficult.

SUMMARY OF THE INVENTION

One aim of the invention is to provide a container with which the flexible dispensing line can be hygienically fixed on the container during storage and transport of the container and with which the line can easily be placed in the use position by a user and can be connected to a dispensing tap of a dispensing device known per se.

A further aim of the invention is to provide a container with which the flexible dispensing line can be reliably housed in the container again after use.

A further aim is to provide a container that can easily be placed with the correct orientation in a dispensing device and which can be coupled in a simple manner to the dispensing device, such as to the dispensing tap and/or to the pressure medium feed.

To this end a container according to the invention is characterised in that the container is provided at the top with a central bridge having a top face and with a peripheral wall, located transversely to the bridge, having two wall sections which border the short sides of the bridge, the chamber being formed in the central bridge.

The grip element can easily be grasped by the user, after which the dispensing line can be extracted from the chamber. The grip element can then be connected to the dispensing tap of the dispensing device, as is described in WO 99/11561 and in Netherlands Patent Application no. 1015 368, which was filed on 31 May 2000 in the name of the Applicant. In this context the chamber can be closed off by the grip element itself or by a separate lid. As a result of the hygienic storage of the flexible line in the chamber, contamination of the line is counteracted, whilst the grip component that protrudes outside the chamber ensures easy handling.

Because the flexible line is housed in the central bridge of the container, the container can easily be handled by means of, for example, two hand grips located on either side of the bridge.

Furthermore, the central bridge is a location on the container that is protected against mechanical contact with the environment during storage or transport, so that damage to the dispensing line is counteracted.

By positioning the outlet end of the dispensing line in or close to a cut-out in a peripheral wall, the outlet end has essentially the same orientation on the container in the storage and transport position as in the use position, in which the grip component of the outlet end is connected to the dispensing tap. As a result, the user is able, after placing the container in a dispensing device, easily to transfer the outlet end from the storage and transport position into the use position.

In one embodiment the container is provided close to the extraction opening with a clamping element that engages on the outlet end of the dispensing line in order to fix this in a defined position on the container during storage and transport. As a result, when the dispensing line is removed from the chamber by a user the outlet end has a secured defined position on the container that corresponds to the position in which the outlet end has to be placed in the dispensing tap of the dispensing device, so that ease of use is optimum.

Both the operating element of a shut-off valve for the feed opening and the air connector can be accommodated in the chamber according to the invention, which operating element and air connector are accessible via a top face of the chamber, so that on placing the container in the dispensing device and closing the lid of the dispensing device an actuating element and an air coupling on the lid of the dispensing device are able to engage on the operating element and the air connector. The operating means for opening the container and the connection for the pressure source can be effectively protected by fitting a protective cap over the chamber.

It is preferable to position the operating element and the air connector in the chamber in one line and to feed the flexible dispensing line in a loop from the operating element along a long side, around the air connector back to the front short side of the chamber. In this way the central bridge can be constructed as an integral unit with the operating element, the air connector and the flexible dispensing line, which integral unit can be produced by machine. Kinking of the dispensing line is prevented by storing the flexible dispensing line in accordance with the loop described above, so that said dispensing line does not suffer any permanent deformation or constriction on prolonged storage and can easily be brought back into its straight position.

It is furthermore preferable to provide the container at a peripheral wall, such as at a top or bottom or at a longitudinal side, with positioning means which extend transversely to the peripheral wall and on placing the container in a chill chamber engage on complementary positioning means in the chill chamber, in such a way that the container is brought into a defined position with respect to the chill chamber. In particular the positioning of the container with respect to the dispensing tap of the drink dispensing device and with respect to a connection for pressure medium that is not positioned on a centre line of the container is facilitated by this means. The chill chamber of the dispensing device can be provided with at least two diametrically located slot-shaped, stepped wall sections, the width of which can decrease towards the base of the chill chamber. The depth of the stepped wall sections, or the distance therefrom to the centre line of the chill chamber, can also taper, so that the container can be introduced into the chill chamber relatively easily through the open top face of the essentially cylindrical dispensing device by introducing the projections into the relatively wide slots. On lowering the container into the chill chamber the walls of the constricting slots engage on the projections, so that the container acquires its correct orientation.

BRIEF DESCRIPTION OF THE DRAWINGS

A few embodiments of a container, as well as an assembly of a container and drink dispensing device according to the invention will be explained in more detail with reference to the appended drawing. In the drawing.

DESCRIPTION OF THE PREFERRED EMBODIMENTS

Figure 1A:
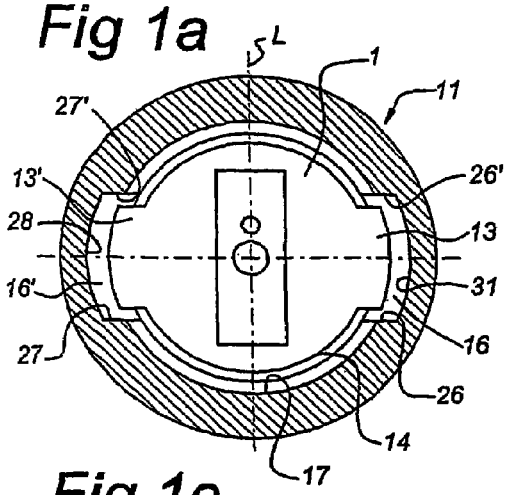
FIGS. 1*a*, 1*b* and 1*c*, 1*d* show a cross-section and, respectively, a longitudinal section of an assembly of a container and a dispensing device, according to the present invention, in a front view and a side view, respectively.
Figure 1B:
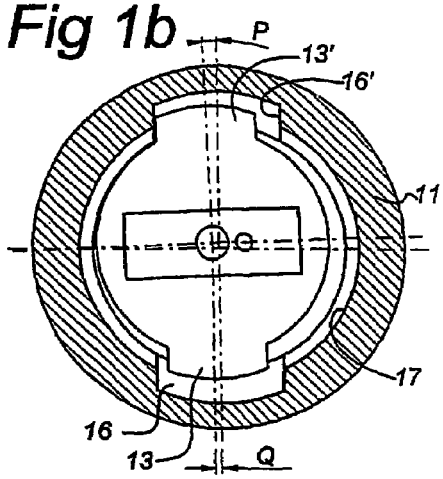
Figure 1C:
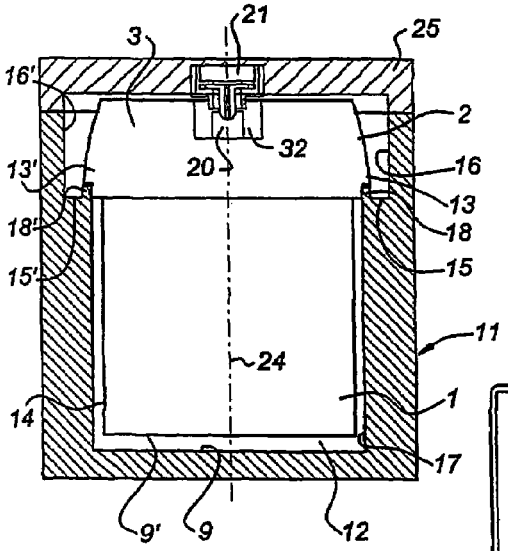

FIGS. 1*a*–1*d* show a container 1 that has been placed in a drink dispensing device 11. The container 1 is provided with a plastic outer jacket and at a top 2 has a cap 3 attached to the outer jacket. The container 1 has an outlet 4, which can clearly be seen in FIG. 1*d*. A flexible dispensing line 5 is connected to the outlet 4, which dispensing line is provided at its outlet end 6 with a shut-off valve 7 and with an outlet section 8, made of relatively rigid plastic, at right angles. The shut-off valve 7 is described in more detail in Netherlands Patent Application no. 1 015 368, which was filed on 31 May 2000 in the name of the Applicant, the contents of which are incorporated herein by reference, and engages on a dispensing tap 19 of the dispensing device 11.

The dispensing device 11 is provided with a chill chamber 12 for accommodating the container 1. The container 1 has two ears 13,13' at its top, which ears protrude laterally with respect to the peripheral wall 14 of the container. The ears 13,13' bear on horizontal supporting surfaces 15,15' of stepped wall sections 16,16' in the chill chamber wall 17. In this way the container 1 is correctly positioned with respect to the chill chamber, both in respect of height and in respect of angular position, so that the dispensing line 5 and the shut-off valve 7 can be connected to the dispensing tap 19 of the dispensing device 11.

Furthermore, the ears 13,13' assist when positioning an air inlet 20 of the container 1 with respect to a coupling element 21, arranged in the lid 25, of a pressure line 22, which pressure line is connected to a compressor 23. As can be seen from FIG. 1*b*, the coupling element 21 is located some distance from the centre line 24, next to the central outlet 4.

When placing the container 1 in the chill chamber 12 the lid 25 of the dispensing device 11 is open and the container 1 is suspended in the chill chamber 12 by bringing the ears 13,13' to bear on the horizontal supporting surfaces 15,15'. As a result of this suspension in the dispensing device, containers of different heights can be used, the distance between the bottom 9' of the container and a base 9 of the chill chamber 12 being able to vary, for a constant and accurately defined position of the air inlet 20 and the outlet 4.

The distance between opposing side walls 26,26' and 27,27' of the stepped wall sections 16,16' can decrease towards the base of the chill chamber 12 whilst the rear walls 28,31 of the wall sections 16,16' can taper towards the centre line 24. As a result the container 1 can easily be placed through the top opening in the chill chamber 12 with the ears 13,13' in the broad positioning slots and the container itself seeks its correct orientation when it is lowered into the chill chamber.

The horizontal supporting surfaces 15,15' are provided with 1 ridges 18,18' which engage in cavities 29,29' in the ears 13,13' of the container 1. The curvature of the ridges 18,18' is oriented in line with line L, see FIG. 1, on which the coupling element 21 for the air connector and the operating element for the spring-loaded shut-off valve of the outlet 4 are located, so that the air connector in the lid and the operating element for the valve are aligned correctly with respect to the container.

After closing the lid 25, the compressor 23 is connected to the air inlet 20 and a spring-loaded shut-off valve of the outlet 4 is pressed down by a lid component, so that the outlet is opened and drink can be dispensed from the container 1 under pressure via the dispensing tap 19 by opening and closing the shut-off valve 7 by means of a handle 10.

Figure 1D:
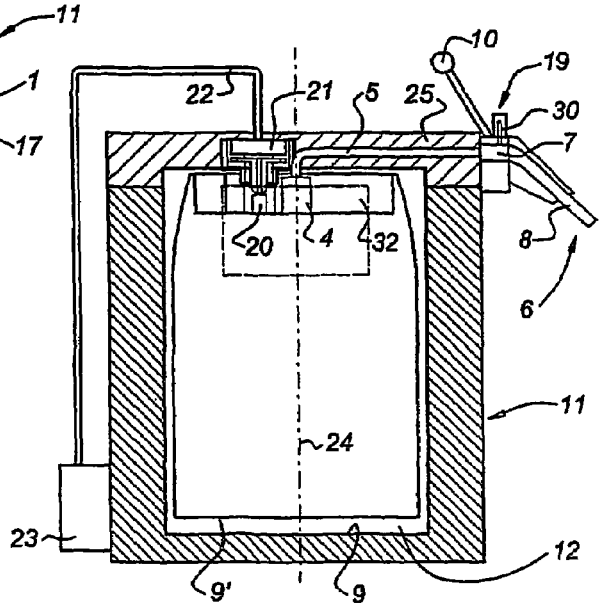
Figure 2:
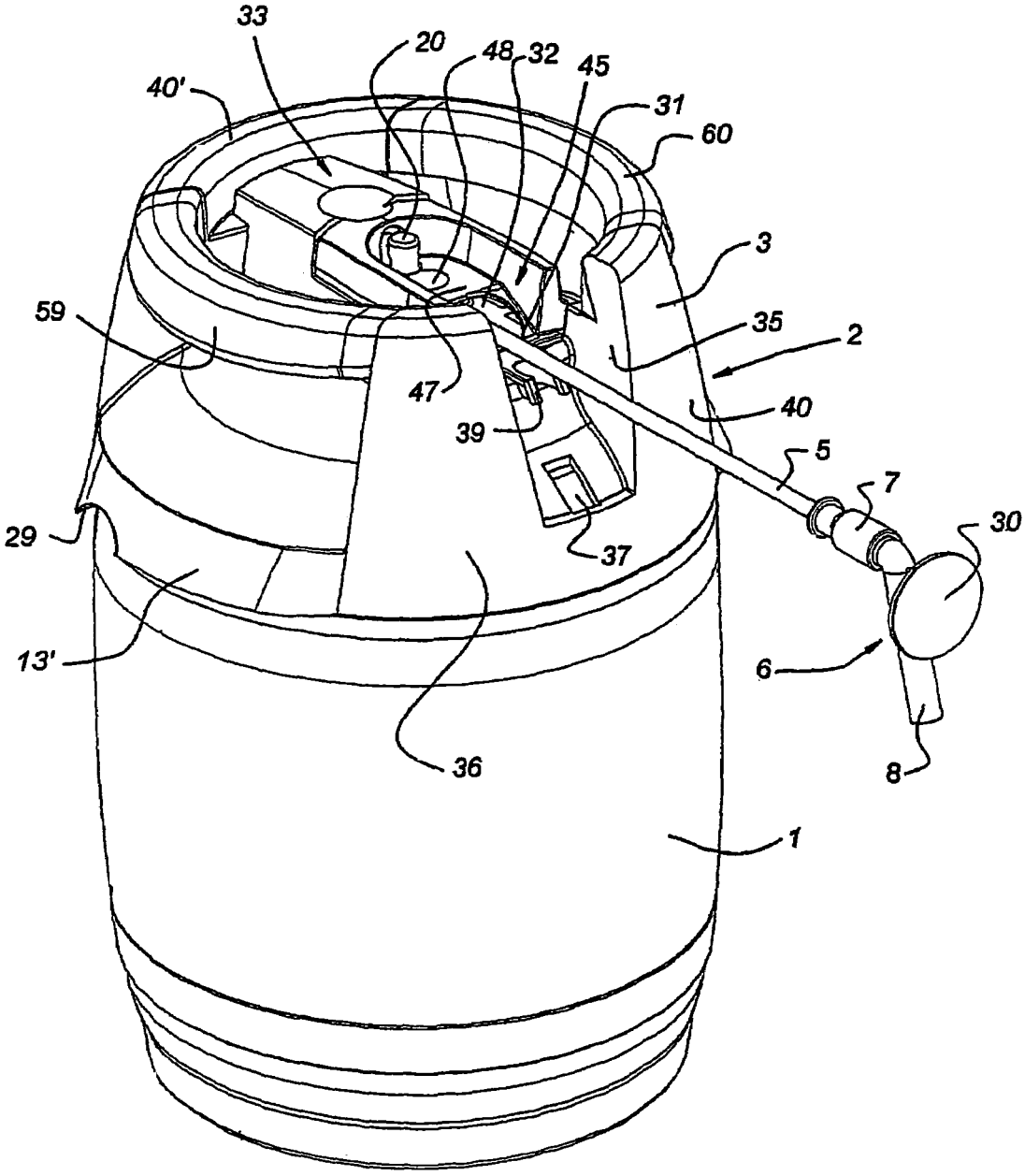
FIG. 2 shows a container according to FIG. 1 with the protective cap removed and with the dispensing line in the extended use position, it being possible for the outlet end to be fitted in a dispensing tap of the dispensing device.

FIG. 2 shows the container 1 with the dispensing line 5 in the extended position, in which the shut-off valve 7 can be connected to the dispensing tap 19. With this arrangement a plate 30 forms a grip component that can be grasped by the user and that can be placed in the dispensing tap 19 in order to position the outlet end 6 accurately in the dispensing tap 19, as is shown diagrammatically in FIG. 1*d*. The dispensing line emerges through an extraction opening 31 from chamber 32, which is accommodated in central bridge 33. The central bridge 33 is located within a peripheral wall 36 of the container that has two hand grips 59, 60, located some distance away from the bridge 33, and two wall sections 40,40' which border the ends of the bridge 33. The dispensing line 5 is connected in the chamber 32 to the outlet 4 of the container 1.

Figure 3:
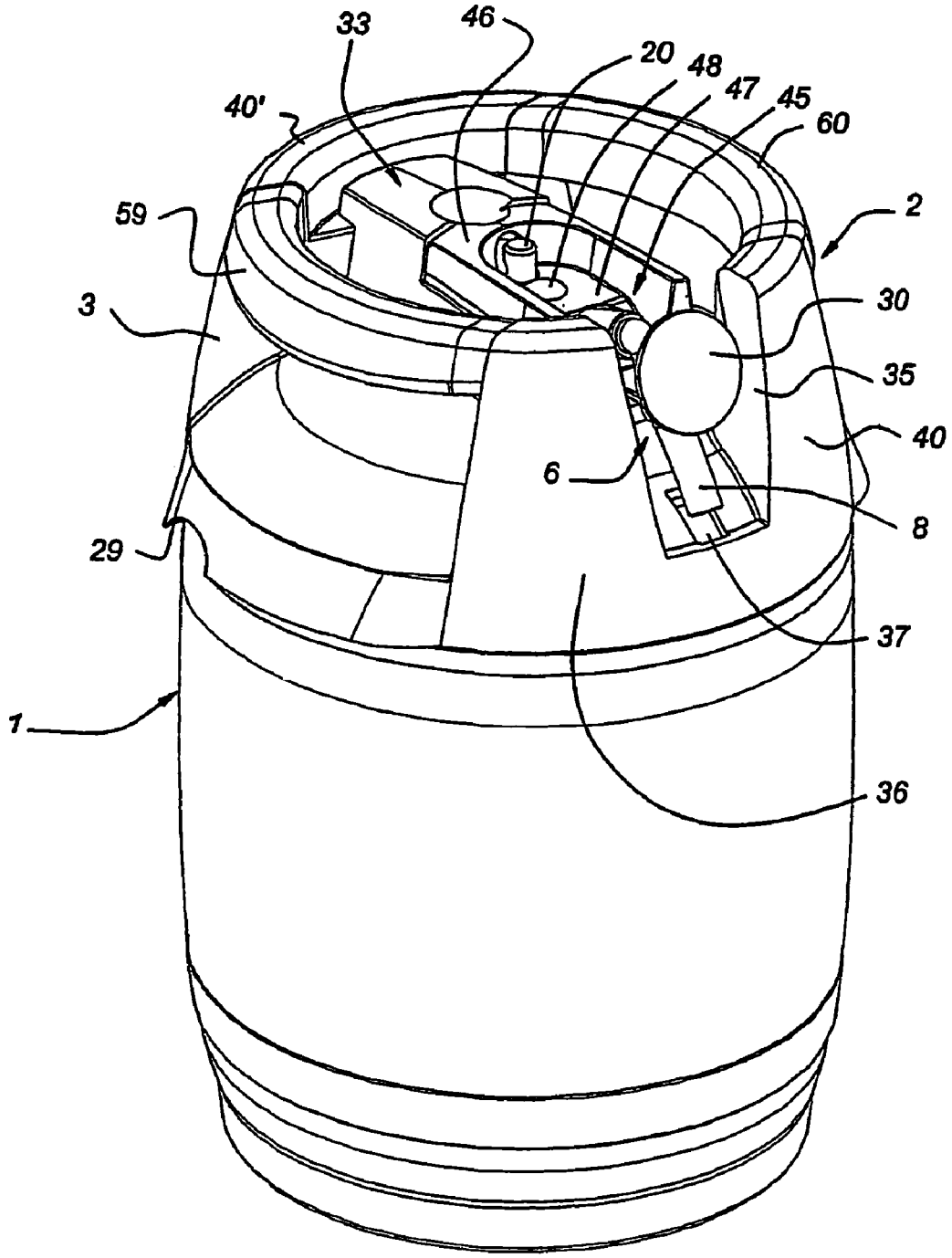
FIG. 3 shows a perspective view of the container according to FIG. 2, with protective cap removed, the dispensing line being placed in the accommodating chamber.

In the storage and transport position that is shown in FIG. 3, the dispensing line 5 is housed in the chamber 32, whilst the plate 30 is located in the cut-out 35 in the peripheral wall 36. The outlet section 8 at right angles is positioned in a slot 37. As a result the outlet end 6 is in a position that to a large extent corresponds to the position in which the outlet end 6 has to be placed in the dispensing tap 19, so that it is clear to a user how the dispensing line 5 and the outlet end 6 have to be brought into a use position that is shown in FIG. 1*d* and in FIG. 2.

In the storage and transport position as shown in FIG. 3, the outlet end 6 of the dispensing line 5 is located in a second compartment 45 that is delimited by the surface of the cut-out 35 in the peripheral wall 36 of the cap 3 and by a top face 46 of the central bridge 33. In the second compartment 45 the air connector 20 extends through a top wall 47 of the chamber 32 so that this can be connected to the coupling element 21 in the lid 25 of the dispensing device. Via an opening 48 in the top wall 47 the lid 25 is able on closing to engage, for example via the coupling element 21, on an operating element 51 (see FIG. 4) for opening the outlet 4. The second compartment 45 can be closed off by a removable protective cap or lid 52, as shown in FIG. 4 and FIG. 5.

Figure 4:
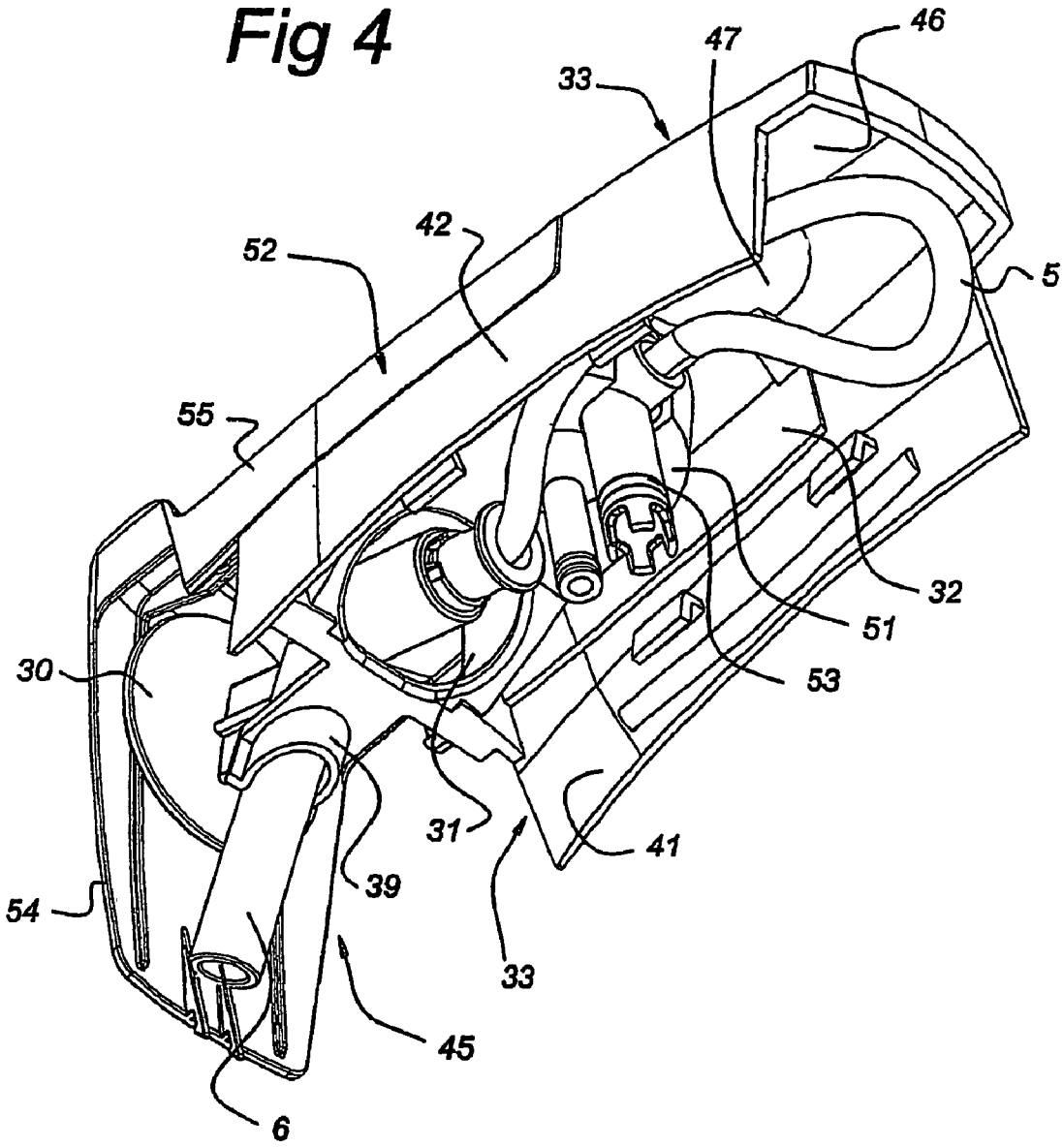
FIG. 4 shows a perspective bottom view of a central bridge, with the accommodating chamber for the dispensing line.

FIG. 4 shows a perspective bottom view of the central bridge 33, side walls 41,42 and the top wall 47 of which delimit the chamber 32. A tube section 53 at right angles is fitted on the end of the dispensing line 5 and, when the operating element 51 is pressed down, engages on a spring-loaded shut-off valve for the outlet 4. To this end, when the lid is closed, part of the lid 25 of the dispensing device extends through the top wall 47 of the chamber 32.

Figure 5:
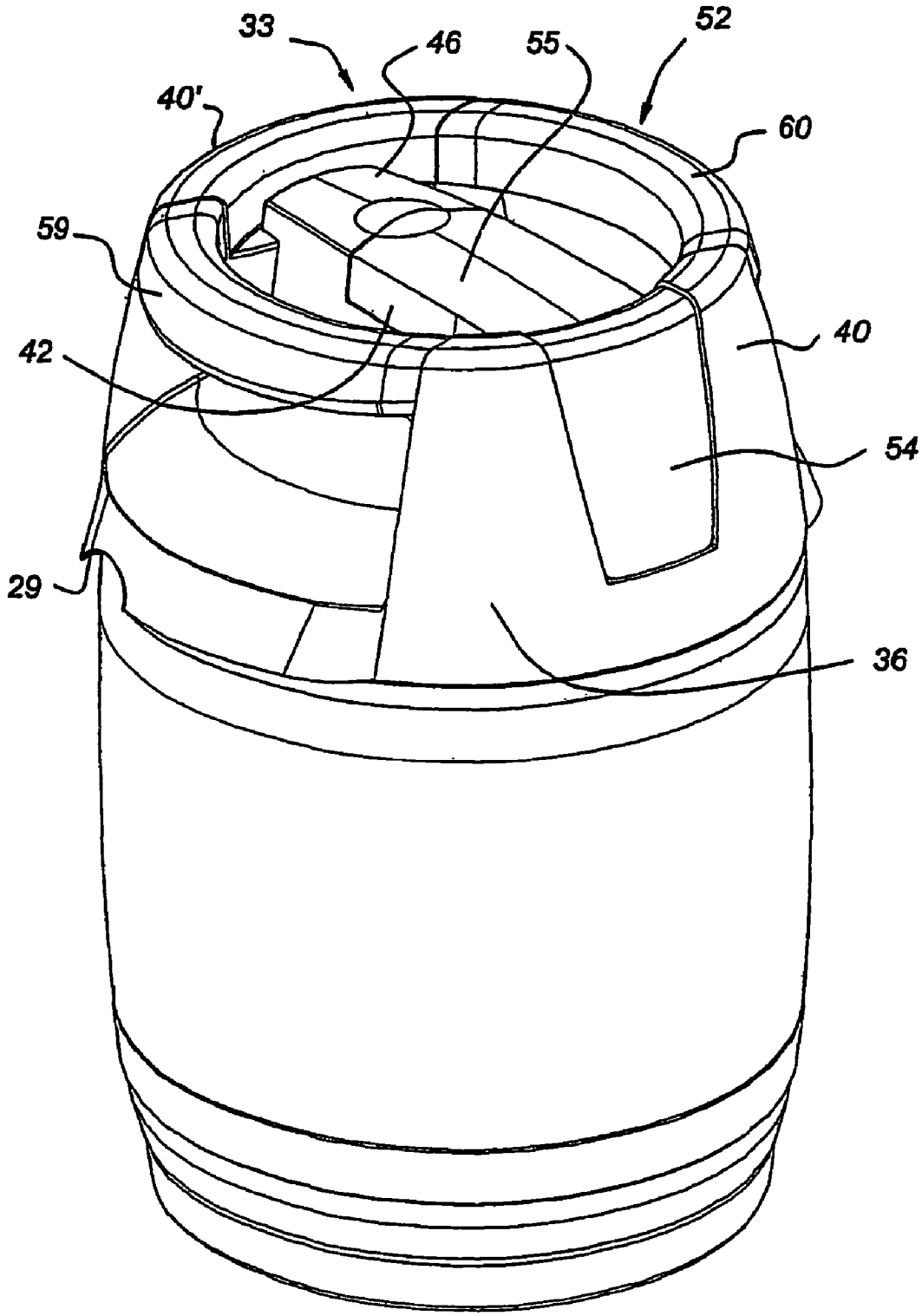
FIG. 5 shows a container according to FIG. 3 with the protective cap fitted, in the storage and transport position.

As shown in FIG. 5 the second compartment 45 is covered by the lid 52, the lid having two sections 54,55 at right angles which are essentially coincident with the plane of the peripheral wall 36 and with a top face 46 of the central bridge 33.

Figure 6:
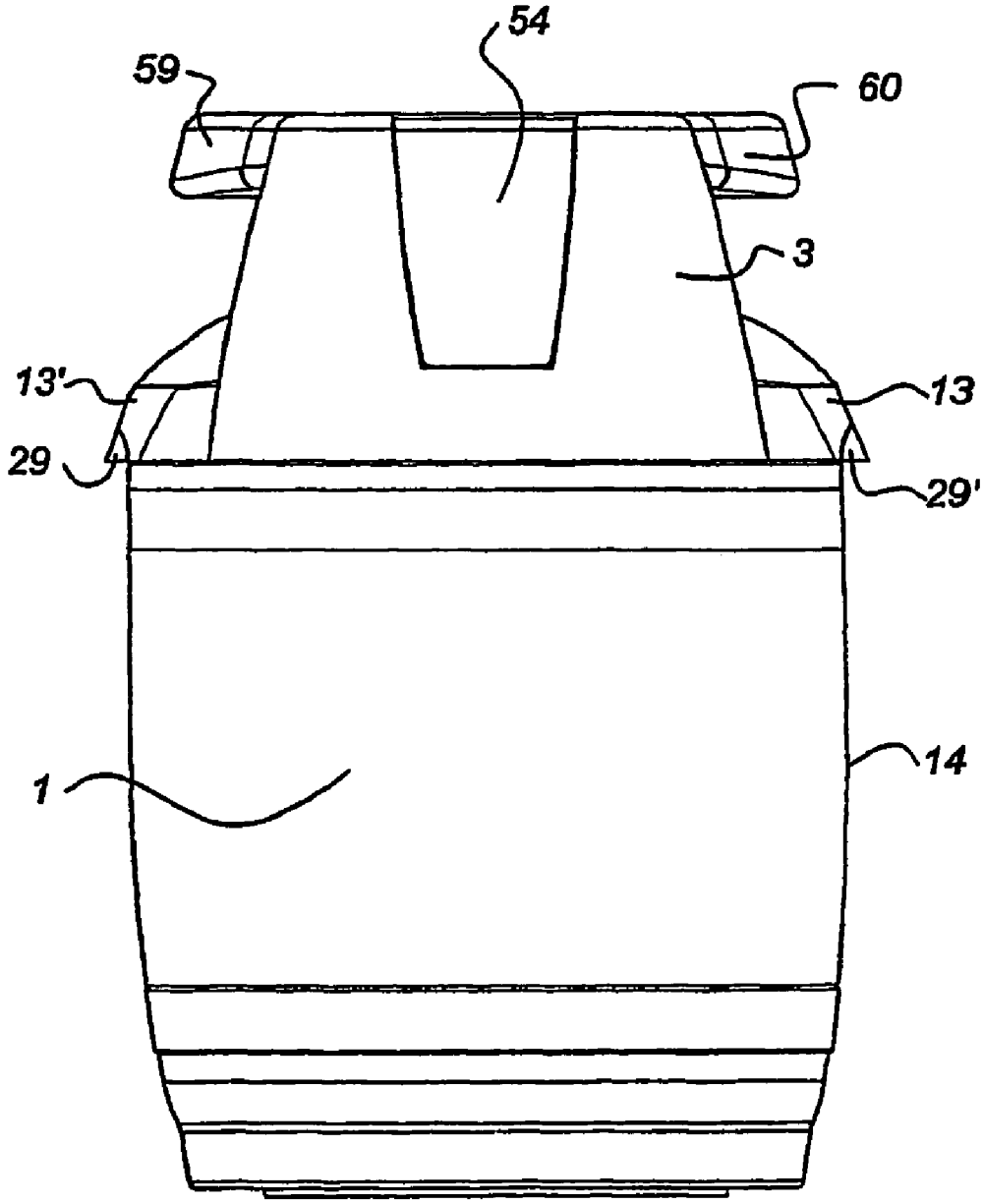
FIG. 6 shows a side view of a container according to the invention provided with positioning ears.

FIG. 6 shows a side view of the container 1, provided with the two ears 13,13', projecting laterally beyond the peripheral wall 14, and with two hand grips 59,60, located on either side of central bridge 33, which can be used by a user to lift the container 1 and place it in the dispensing device.

Figure 7:
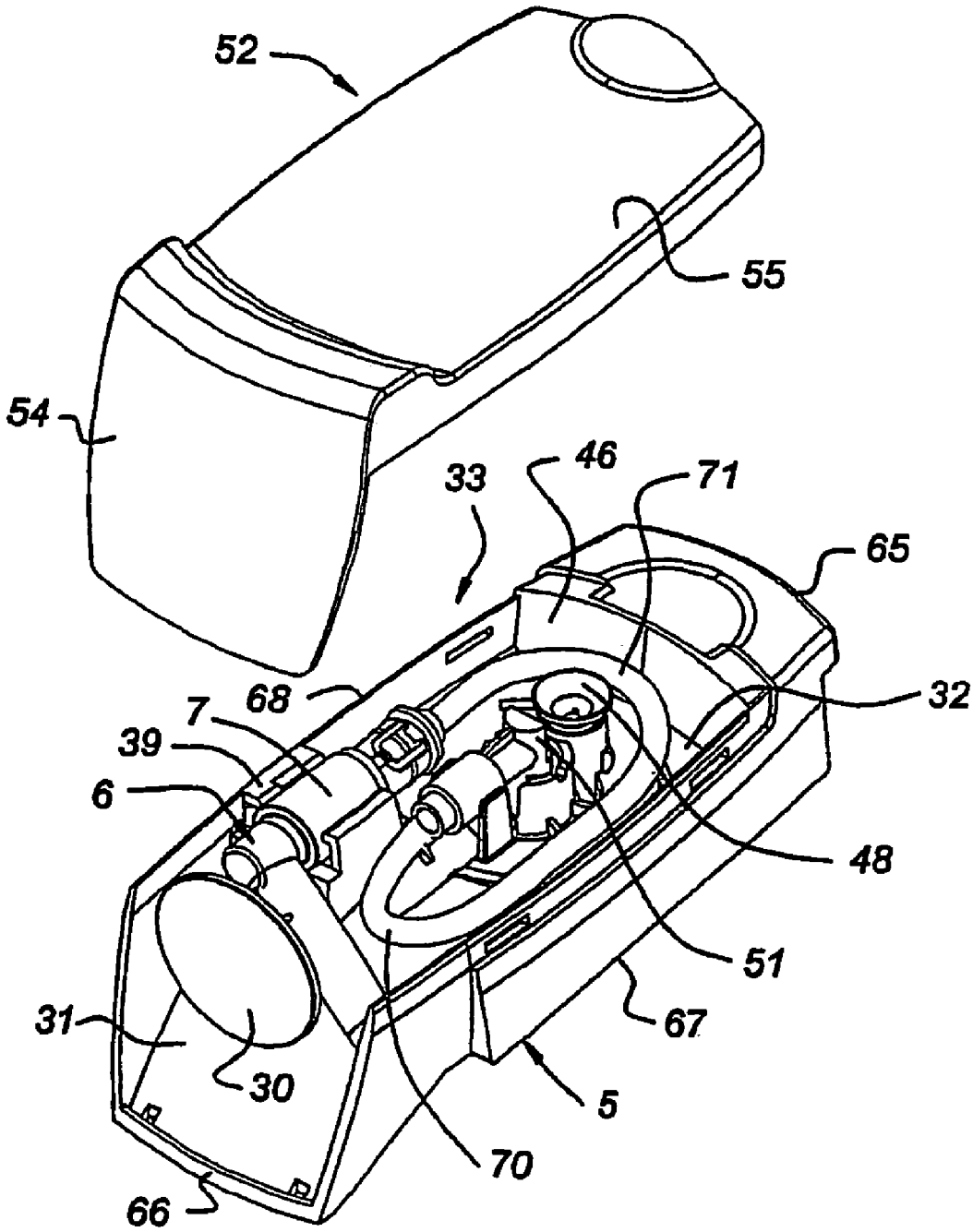
FIG. 7 shows a perspective view of a chamber with the flexible dispensing line constructed as an integral unit.

FIG. 7 shows a central bridge 33 that is constructed as an integral unit with the flexible dispensing line 5, the operating element 51 and air connector 48. Corresponding components in FIG. 7 are provided with the same reference numerals as in FIGS. 2–6. The flexible dispensing line 5 extends from the operating element 51 towards the front short side 66 of the bridge 33. The dispensing line 5 then runs via a first bend 70 along a long side 67 of the bridge 33 and extends via a second bend 71 around the air connector 48, which is in line with the operating element 51. The dispensing line 5 runs further from the rear short side 65 of the bridge 33 to the front short side 66 via the second long side 68 of the bridge 33. The outlet end 6 is held in place by the clamping element 39 close to the open short side 66 of the chamber 32. The chamber 32 is closed off by the L-shaped lid 52.

The arrangement shown can be efficiently assembled by machine, permanent deformation in the dispensing line 5 as a result of kinking or folding double being prevented. After removal of the lid 52, the gripper component 30 is in a position that is easily accessible for the user and that corresponds to the position in which the outlet end 6 has to be fitted in the dispensing device.

The bridge 33 according to FIG. 7, that is constructed as an integral unit, can be clicked into the mid section of the top 2 of the container so that the opening 31 in the chamber is coincident with the cut-out 35 in the wall section 40 and is closed off by the short section 54 of the lid 52.

The connector or opening 48 and the operating element 51 are placed in the correct position with respect to the lid 25 of the dispensing device 11, viewed in the longitudinal direction of the central bridge 33, by means of the cavities 29,29' in the ears 13,13'.

The invention claimed is:

1. A container for a drink, said container being of substantially cylindrical shape and having an drink outlet and air inlet at or near a top thereof;

said container further comprising an at least partly flexible dispensing line that is attached to said drink outlet in use and that has an outlet end adapted to engage a dispensing tap of a dispensing device; and two gripping members at a top of said container;

a central bridge between said two gripping members, said central bridge comprising a connector having one end adapted to engage said air inlet and a second end adapted to connect to an air outlet of a dispensing device, and an operating element that cooperates with said drink outlet and receives an inflow end of said dispensing line for opening said drink outlet, wherein said central bridge, said connector and said operating element are an integral unit that is fixed to the top of said container.

2. The container of claim 1, wherein said dispensing line is stored in said central bridge prior to use of said container.

3. The container of claim 1, wherein said gripping members are spaced from and oriented generally parallel with said central bridge.

4. The container of claim 1, wherein said container is pressurized.

5. The container of claim 1, wherein said container is adapted to contain a carbonated drink.

* * * * *